US008597143B2

(12) United States Patent
Newman

(10) Patent No.: US 8,597,143 B2
(45) Date of Patent: Dec. 3, 2013

(54) BATTING TEE AND TRAINING SYSTEM

(76) Inventor: Todd H. Newman, Alpine, UT (US)

( * ) Notice: Subject to any disclaimer, the term of this patent is extended or adjusted under 35 U.S.C. 154(b) by 251 days.

(21) Appl. No.: 13/174,660

(22) Filed: Jun. 30, 2011

(65) Prior Publication Data

US 2012/0172153 A1 Jul. 5, 2012

Related U.S. Application Data

(60) Provisional application No. 61/360,570, filed on Jul. 1, 2010.

(51) Int. Cl.
*A63B 69/00* (2006.01)
*A63B 71/00* (2006.01)

(52) U.S. Cl.
USPC ..... 473/417; 473/422

(58) Field of Classification Search
USPC ..... 473/417, 419, 420, 422, 423, 454, 508, 473/511, 386, 387; D21/716–718; 446/106; 285/210; 211/204, 198, 180; 108/95; 248/94, 95; 124/5, 16
See application file for complete search history.

(56) References Cited

U.S. PATENT DOCUMENTS

| | | | | |
|---|---|---|---|---|
| 1,593,577 | A | 7/1926 | Kaiser | |
| 2,616,692 | A | 11/1952 | Bird | |
| 2,652,250 | A | 9/1953 | Alder et al. | |
| 2,884,250 | A * | 4/1959 | Patterson | 473/423 |
| 3,044,670 | A * | 7/1962 | Barefoot | 223/46 |
| 3,139,282 | A | 6/1964 | Lande | |
| 3,176,985 | A * | 4/1965 | Chupa | 482/86 |
| 3,883,138 | A * | 5/1975 | Chorey | 473/417 |
| 3,940,131 | A | 2/1976 | St. Claire, Jr. | |
| 4,227,691 | A | 10/1980 | Lefebvre et al. | |
| 4,383,686 | A * | 5/1983 | Cardieri | 473/417 |
| 4,709,924 | A | 12/1987 | Wilson et al. | |
| 4,819,937 | A * | 4/1989 | Gordon | 473/417 |
| 4,938,478 | A | 7/1990 | Lay | |
| 5,004,234 | A | 4/1991 | Hollis | |
| 5,173,532 | A * | 12/1992 | Endo et al. | 524/425 |
| 5,388,823 | A | 2/1995 | Prieto | |
| 5,580,047 | A * | 12/1996 | Shih et al. | 473/417 |
| 5,644,189 | A * | 7/1997 | Busby | 313/318.01 |
| 5,662,536 | A | 9/1997 | Martinez | |
| 5,897,444 | A | 4/1999 | Hellyer | |
| 5,928,092 | A * | 7/1999 | Keeter et al. | 473/417 |
| D430,243 | S | 8/2000 | Alberti et al. | |
| 6,358,163 | B1 * | 3/2002 | Tanner | 473/417 |
| 6,413,175 | B1 * | 7/2002 | Mooney, Jr. | 473/417 |
| 6,579,195 | B2 | 6/2003 | Lamb | |
| 6,682,445 | B1 | 1/2004 | Tanner | |
| 6,878,077 | B2 | 4/2005 | Andrews | |
| 7,354,360 | B1 | 4/2008 | Eckstein | |
| 2008/0064534 | A1 | 3/2008 | Lortscher | |
| 2012/0172153 | A1 * | 7/2012 | Newman | 473/417 |

* cited by examiner

*Primary Examiner* — Gene Kim
*Assistant Examiner* — M Chambers
(74) *Attorney, Agent, or Firm* — Brett Peterson; Pate Peterson PLLC

(57) ABSTRACT

An improved baseball or softball batter training system and batting tee is provided. The tee provides a significantly increased useful life as compared to prior art tees as well as improved hitting dynamics. The batting tee forms part of a batter training system which allows multiple batting tees and adapters to be used together to teach proper batting skills to a batter while providing immediate tactile feedback to ensure proper technique.

22 Claims, 15 Drawing Sheets

BATTING TEE AND TRAINING SYSTEM

PRIORITY

The present application claims the benefit of U.S. Provisional Application Ser. No. 61/360,570, filed Jul. 1, 2010 which is herein incorporated by reference in its entirety.

THE FIELD OF THE INVENTION

The present invention relates to an improved batting tee and batter training system for baseball and softball batter training. More specifically, the present invention relates to a batter training system which allows for a variety of different batter training drills which may be used to teach a batter to use better technique. Additionally, the present invention relates to a batting tee which provides improved durability over existing batting tees, allowing the batting tee to be used over a significantly longer period of time before the tee wears out or becomes inoperable.

BACKGROUND

Various different batting tees are currently available for use in training baseball and softball players to be better batters. Batting tees are used for several reasons. One reason is that the pitchers on a baseball or softball team or the pitching machines at a training facility are far outnumbered by the remaining players. As such, using batting tees allows more players to practice batting at a given time. Additionally, the use of a batting tee can allow for training exercises to improve batting skills which are not easily improved upon while batting balls thrown by a pitcher or pitching machine. The use of a batting tee allows a batter to hit a ball in a consistent and repetitive location in performing batting exercises to build a specific skill or address a specific weakness.

Existing batting tees have several drawbacks. One drawback is durability. Existing batting tees do not hold up well to heavy use. Particularly when used by professional athletes, existing batting tees can wear out fairly quickly and need frequent replacement. Another drawback of existing batting tees is their inability to be used in specific training exercises. Existing batting tees have little or no ability to be customized and configured to provide training drills which address specific batting skills or weaknesses. Existing batting tees can also be somewhat cumbersome and difficult to use.

There is a need for an improved batting tee and training system. There is a need for a batting tee which is more durable and easier to use than existing batting tees. There is a need for a batting tee and training system which is more portable than existing batting tees. There is a need for a batter training system which is customizable to allow for many different training drills to address specific batting skills and weaknesses.

SUMMARY OF THE INVENTION

It is an object of the present invention to provide an improved batting tee and training system.

According to one aspect of the invention, a batting tee is provided which is more durable than existing batting tees. Batting tees typically hold a ball with a wound rubber cone which is attached to a support. These rubber cones take significant abuse because the bat often strikes the cone, bending and tearing the cone. A batting tee system is provided which has a tee cone attached to a flexible rod which distributes the bat impact forces better so that the support cone does not always bend and fail at the same point, and which also reduces the forces transferred to the support cone by the bat.

According to another aspect of the invention, a batter training system is provided which is significantly more portable and easier to use than existing batting tees. The system uses a combination of quick disconnect fittings and self locking joints to allow the tee to be quickly and easily set up in a desired configuration. The tee may also be broken down into a compact configuration which is easy to transport.

According to another aspect of the invention, a batter training system is provided which allows additional pieces to be combined with a batting tee to teach the batting skills necessary for success. The system may be easily configured to suit different batters and to address specific batting skills These and other aspects of the present invention are realized in a batting tee and training system as shown and described in the following figures and related description.

BRIEF DESCRIPTION OF THE DRAWINGS

Various embodiments of the present invention are shown and described in reference to the numbered drawings wherein.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
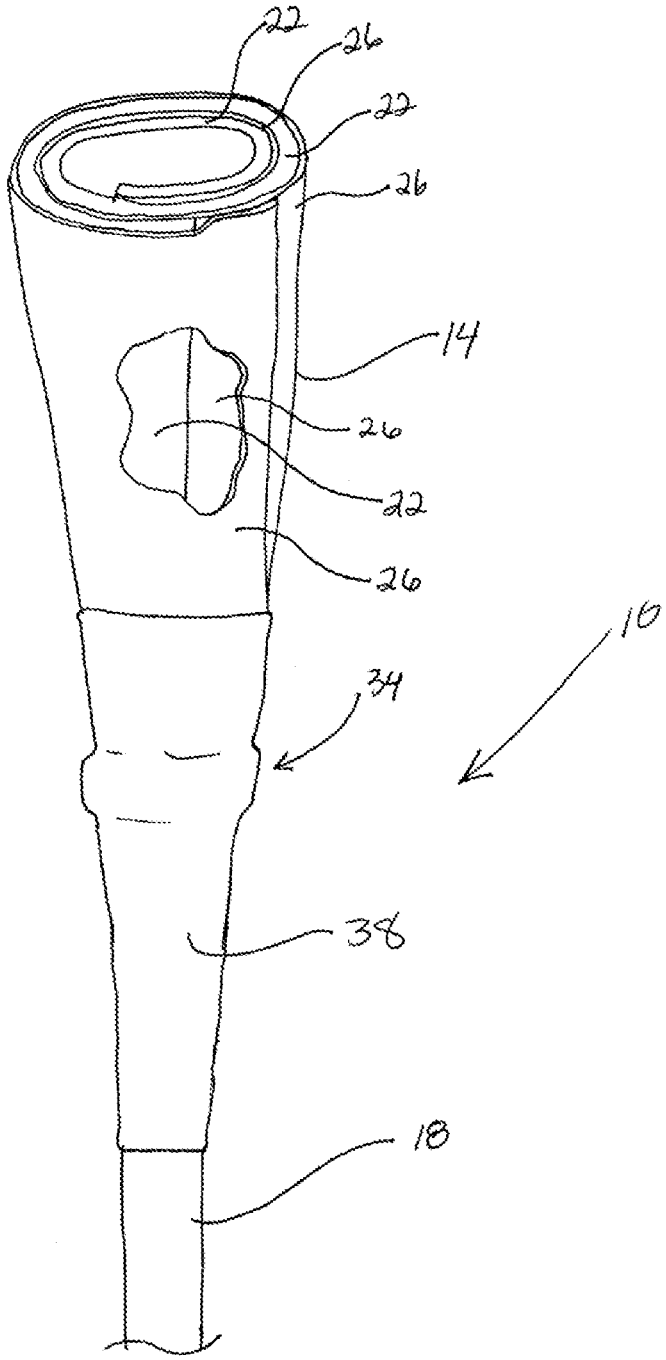
FIG. 1 shows a partially cut away side view of a batting tee of the present invention.
Figure 2:
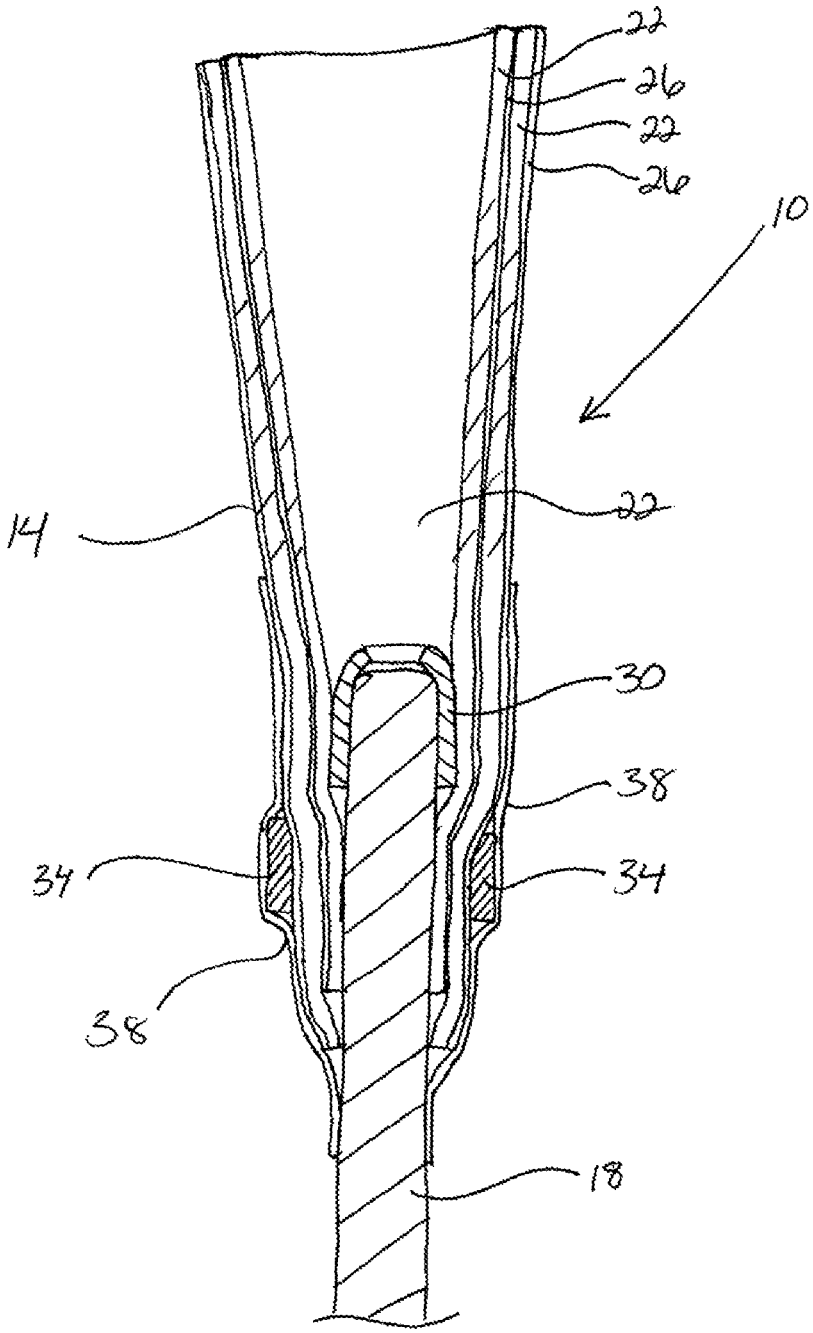
FIG. 2 shows a cross-sectional view of the batting tee of FIG. 1.

Turning now to FIGS. 1 and 2, a tee for a batter training system of the present invention is shown. FIG. 1 shows a partially cut away side view of the tee 10 and FIG. 2 shows a cross-sectional view of the tee. The tee 10 includes a cone 14 which holds a ball on the top thereof and a flexible rod 18 extending downwardly from the cone. The cone 14 is a rolled cone which includes alternating layers of rubber 22 and cloth 26. The cone 14 is attached to a moderately flexible rod 18, providing some flexibility when the cone is struck by a bat, which happens nearly every time a ball is hit by a bat.

While prior art batting tees have used rubber cones to support a ball, significant drawbacks occur. The rubber cones in prior art devices quickly break at the point where the rubber cone meets the lower support structure. These prior art devices fail quite quickly during heavy use, such as when used by a professional baseball player.

Applicant has discovered that the failure of prior art rubber support cones primarily occurs at the top of the cone at the point where the cone attaches to the underlying support rod. Applicant has discovered that the top of the cones deform as the bat contacts the cone at high speed, and a high amount of friction is generated between the cone and the bat. The cone is torn at the top by the bat, and the high frictional force combined with the design of the prior art cones causes a high degree of stress and kinking of the cone at the point where the cone meets the support rod, leading to failure. Prior art cones use a rigid member attached to the cone. Attachment to a rigid member does not disperse energy and increases the failure rates of the rubber cone.

The inventive cone 14 and flexible rod 18 solve these problems. The cone 14 is formed by alternating layers of rubber sheet 22 and a cloth 26. The rubber sheet 22 is about 0.06 inches thick, and may be a butyl rubber, for example. The cloth 26 is preferably a woven synthetic cloth, such as a nylon cloth, and preferably has a rubberized coating or a waterproofing coating on one side, as this helps keep the cloth from unraveling. If such a coating is present on the cloth 26, the coating is ideally placed inwardly when rolling the cone 14 so that the cloth, and not the coating, contacts a bat when in use. The cone 14 is formed by taking trapezoidal or semi-circular shaped pieces of rubber 22 and cloth 26 and rolling these into a cone around the support rod 18, placing the cloth 26 outside of the rubber so that the cloth surrounds the resulting cone as shown in FIG. 1. If necessary, the top of the cone 14 is trimmed flat as shown. The layers of rubber 22 and cloth 26 are preferably not attached together above their attachment to the rod 18 so as to improve the flexibility of the tee 10 when hit by a ball.

The cloth 26 has low friction and keeps the bat from gripping the rubber as the bat hits the cone, preventing the tearing of the top of the rubber from friction between the bat and rubber. The cloth 26 also reduces friction between adjacent layers of rubber 22. The reduction in friction provided by the cloth 26 thus reduces the bending and stretching stresses placed on the cone 14, causing less bending at the joint between the cone 14 and rod 18. This significantly extends the life of the tee 10. The inventive tees 10 have lasted many times longer than prior art tees.

The cone 14 is typically about six to eight inches long and has an opening on the end of about one and one half to three inches in diameter. A larger cone which has an opening of about three to four inches in diameter and is made of rubber approximately one eighth of an inch thick may also be used. The larger cone is used to hold a large ball such as a basketball, and is used to teach a batter to continue applying force to the bat even after making contact with a ball.

FIG. 2 shows a cross sectional view of the tee 10, further illustrating the construction thereof. The support rod 18 is preferably made out of polyacetal, such as is often sold under the trade name DELRIN®. Polyacetal has a good strength and stiffness. More importantly, the inventor has discovered that polyacetal has the ability to withstand repeated flexing or bending even to large angles and withstand repeated impact without changing shape and becoming permanently bent. One half inch diameter rod 18 is used. Using an approximately 0.5 inch polyacetal rod 18 provides an optimum amount of flexibility without encountering permanent deformation or breakage of the rod 18. Some flexibility of the rod 18 is desirable to reduce the stresses in the cone 14 and to allow for a good hitting feel.

To reduce the bending stress in the cone 14 where the cone meets the support rod 18, the end of the support rod is made larger and given a radiused end. This may be economically accomplished by placing a short (about 1 inch) section of rubber or vinyl tubing 30 partially over the end of the rod 18 as shown. Alternatively, a rod 18 with an integrally formed enlarged end could be used. The enlarged end provided by the tubing 30 helps form the cone 14 and helps reduce the bending stress in the cone 14 adjacent the rod end.

After placing the tubing 30 on the end of the rod 18, the rubber 22 and cloth 26 are rolled around the rod to form a cone 14 as shown. The cloth 26 surrounds the outside of the rubber 22. The cone is typically formed of two layers of rubber 22 and slightly more cloth as shown. A metal crimp ring 34 is placed around a lower part of the rubber 22 and cloth 26, preferably above the bottom corners of the pieces of rubber and cloth, and is crimped in place to secure the cone 14 and maintain the shape of the cone. A covering 38 such as heat shrink tubing is then placed over the bottom half of the cone and over the metal ring 34 and shrink in place to further strengthen and protect the cone 14.

The resulting tee 10 and cone 14 have proved to be significantly more durable than existing batting support cones, in many cases lasting ten times longer or more. This is largely because the rod 18 can flex and reduce energy transfer to the tee 10 and because the cloth 26 prevents the bat from gripping the rubber 22 as the bat contacts the cone 14 at high speed, preventing the tearing of the rubber and significantly reducing the bending and stretching forces applied to the rubber, particularly at the base of the cone. The other structures of the cone 14, particularly the enlarged and rounded top section provided by tube 30, also help to reduce the bending and stretching of the cone 14. The construction of the cone 14 achieves a significant improvement in the life of the tee 10. The use of a polyacetal rod 18 also improves the life of the tee 10. The use of both the improved cone 14 and polyacetal rod 18 together provide a significant increase in the life of the tee 10.

Figure 3A:
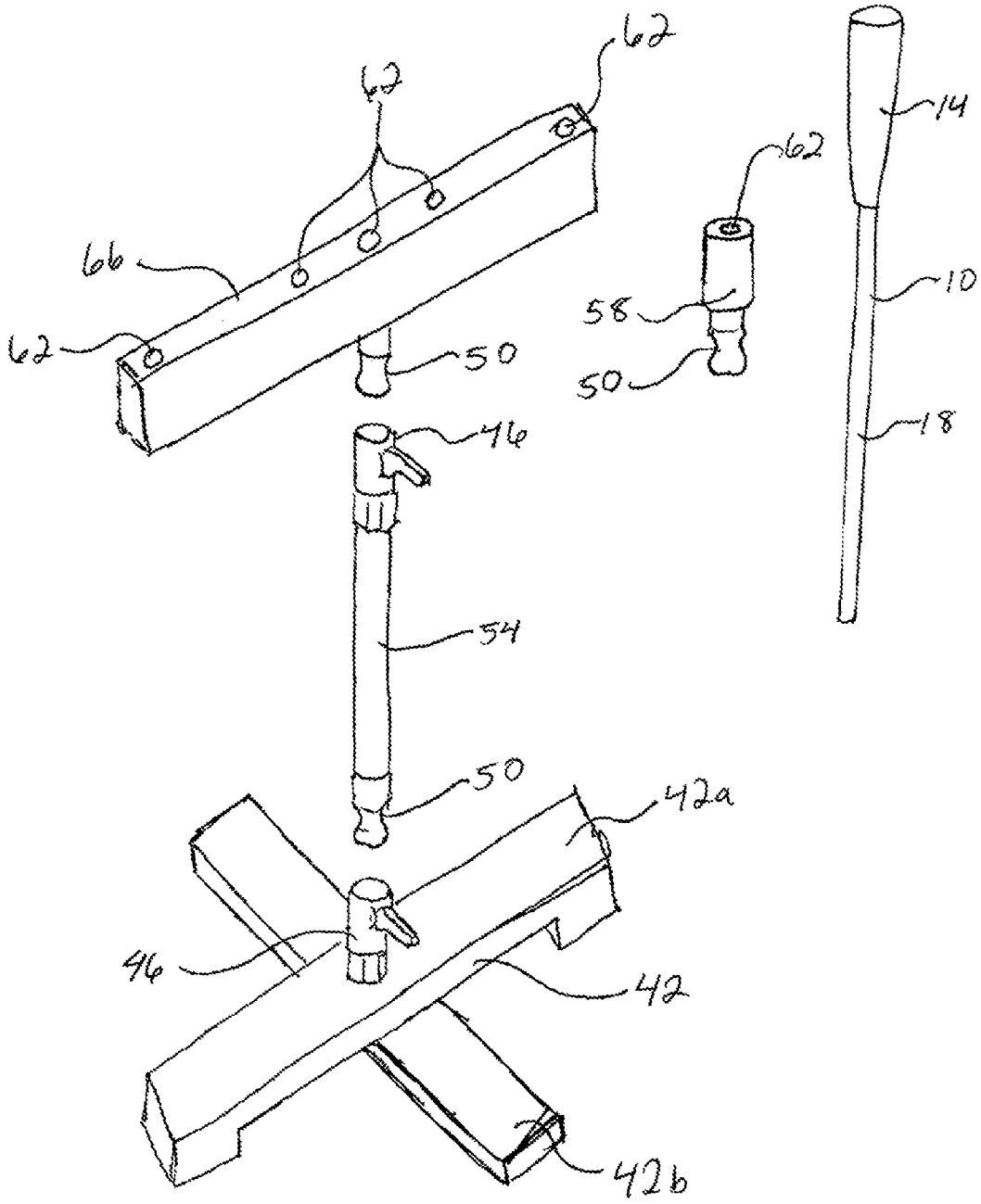
FIG. 3A shows a batting tee system of the present invention.

The tee 10 is used as part of a modular batter training system. FIG. 3A shows the basic elements of the system. A base 42 is used to support the batting system. Preferably, the base may use two arms 42*a*, 42*b* which may pivot into an 'X' shape as shown for use and pivot together about a central axis for storage. The base includes a quick release coupler 46 to allow other pieces to be attached thereto. Corresponding couplers 50 are used on the attachable parts of the system as necessary. The system may use cam lock quick release hydraulic type couplers to join pieces to each other. Female couplers 46 may be modified by replacing an internal rubber washer seal with a plastic seal to stiffen the resulting joint and to reduce the angle to which the resulting joint may bend. The male coupler pieces 50 need not be modified. Alternatively, quick release couplers similar to those used on bicycle tires or seat posts may be used to allow for quick coupling and adjustability in attaching the various parts of the system together.

The system is provided with a few post extension pieces 54. The post extension pieces 54 are hollow, allowing the support rod 18 to pass therethrough as required. The couplers 46, 50 also allow the rod 18 to pass therethrough. The post extension pieces 54 typically have a male coupler 50 and a female coupler 46. The system also includes mounting heads which receive the tees 10. A single mounting head 58 may be used which has a single clamp 62 to receive rod 18 and a male coupler 50. The rod is able to pass through the clamp 62 and male coupler 50 for flexibility in adjusting the height. A T-bar mounting head 66 may be used which includes a plurality of clamps 62 and a single male coupler 50 as shown. Preferably five clamps 62 are used in the T-bar mounting head 66, having a central clamp 62 and four clamps 62 which divide the T-bar head into thirds as shown. The T-bar mounting head is preferably about twenty inches long, two inches high, and one inch thick.

One advantage of the present invention over the prior art is that the tee 10 can be placed in a greater range of positions and can be place the ball in a lower position to allow for training exercises in the lower portion of the strike zone and to accommodate smaller batters. By shortening the rod 18, the device can properly function with a ball held as low as ten inches off of the ground. In use, either the T-bar mounting head 66 or the single mounting head 58 may be used with one or more post extension pieces 54 to alter the overall height of the batting tee. No post extension 54 would be used when a short batter is using the batting tee, and one or two post extensions 54 would be used with a taller batter. Typically, a post extension 54 is used in combination with the T-bar mounting head 66. The quick release couplers 46, 50 allow the batting tee to be quickly set up and quickly modified or changed.

Figure 3B:
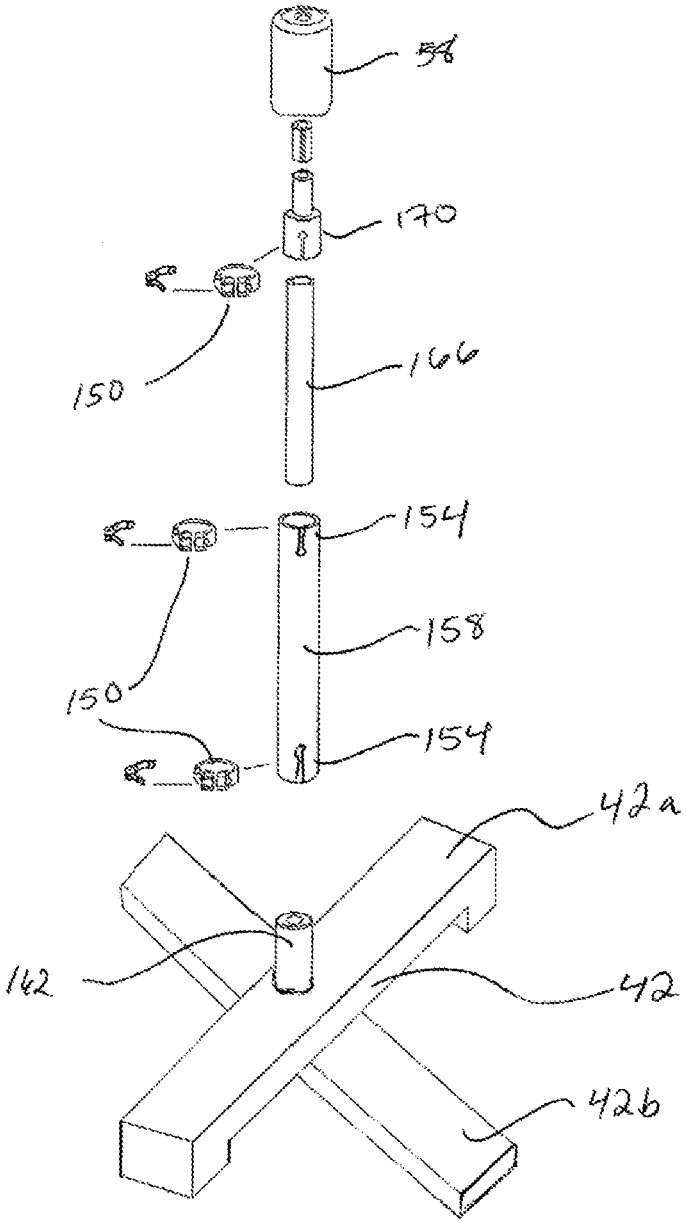
FIGS. 3B and 3C show a batting tee system similar to that of FIG. 3A.
Figure 3C:
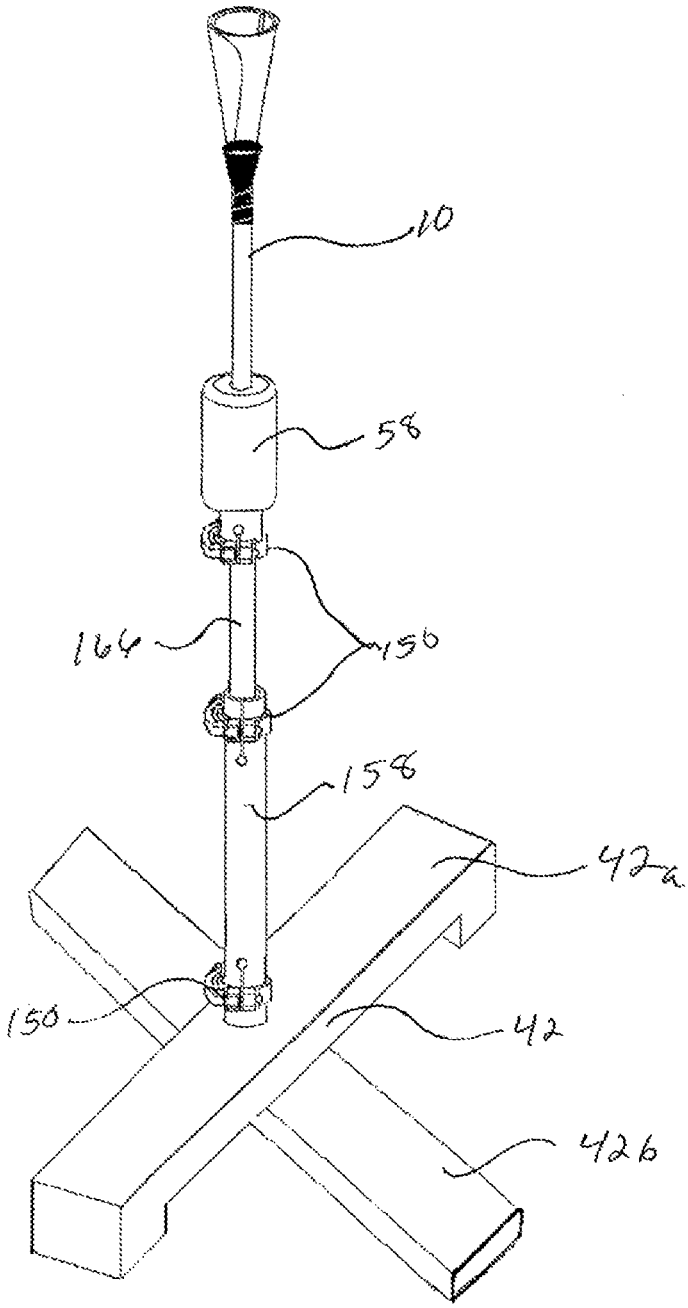

Turning now to FIGS. 3B and 3C, the present invention is shown using different clamps on the body of the device. For quick release couplers, the device uses a cam lock clamping ring 150 to compress a split section 154 of extension post tubing 158. The clamping rings and split tubing work in a manner similar to the quick release couplings used on many bicycles and scooters. The base 42 has a post 162 extending therefrom. The body of the device includes a tube 158 which fits around the post 162, a clamp 150 to secure the tube 158 to the post, an extension post tube 166 which fits inside of tube 158, an associated clamp 150, and a tube collar 170 and clamp 150 to attach a mounting head 58 (or T-bar mounting head 66) to the device. The clamps 150 compress the split sections 154 of the tubing 158 and lock it against the mating piece, clamping the body of the device together as shown in FIG. 3*c*. The clamps 150 allow the height of the device to be easily adjusted to suit different users and applications. It is advantageous to provide a device with a body made of hollow tubes 54, 158, 166. This allows the rod 18 of a tee 10 to be placed into a mounting head 58 and allows the rod 18 to extend down into the tubes 54, 158, 188, allowing greater versatility in using the device.

Figure 10:
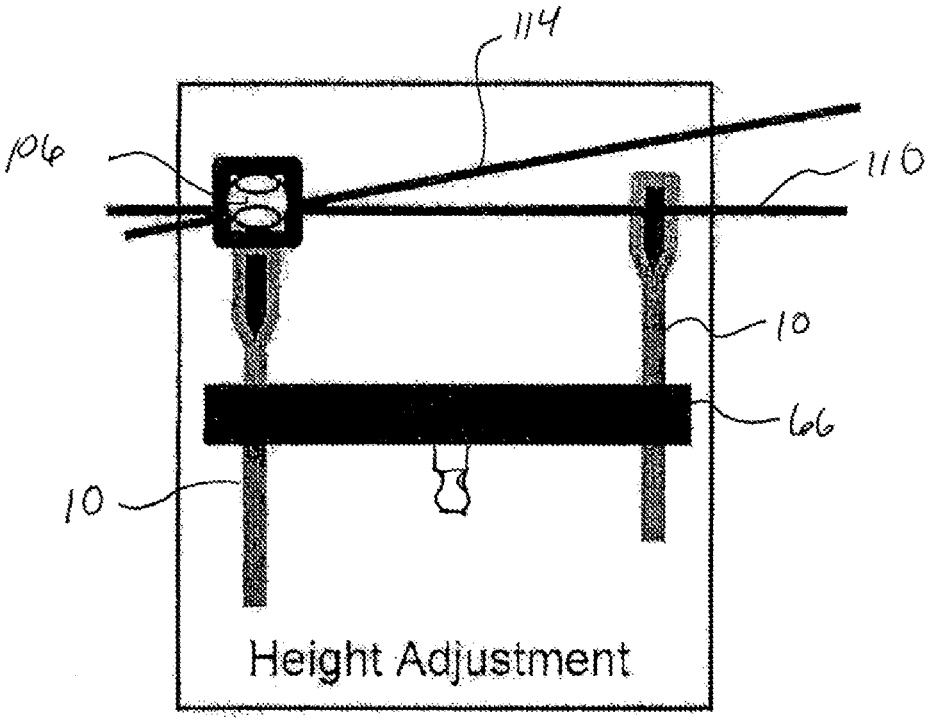
FIGS. 10 through 17 show exemplary training routines possible with the present system.
Figure 11:
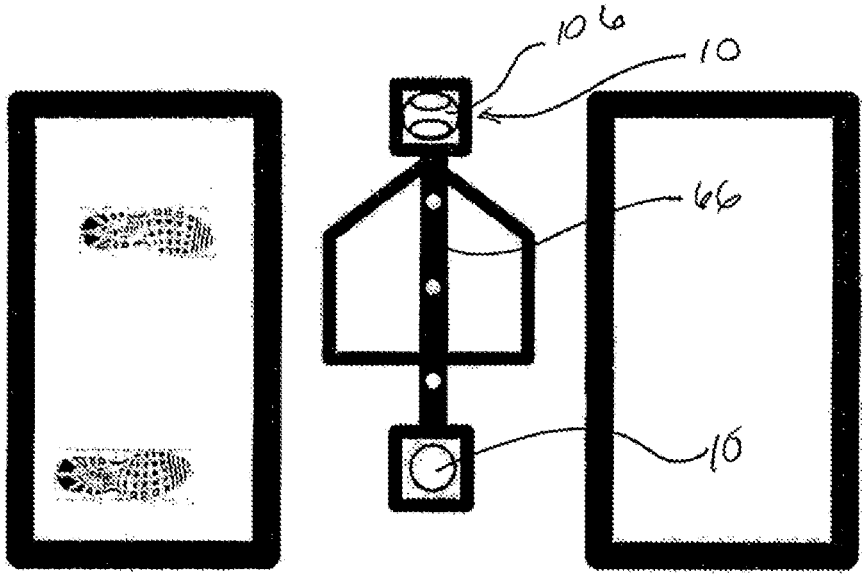
Figure 13:
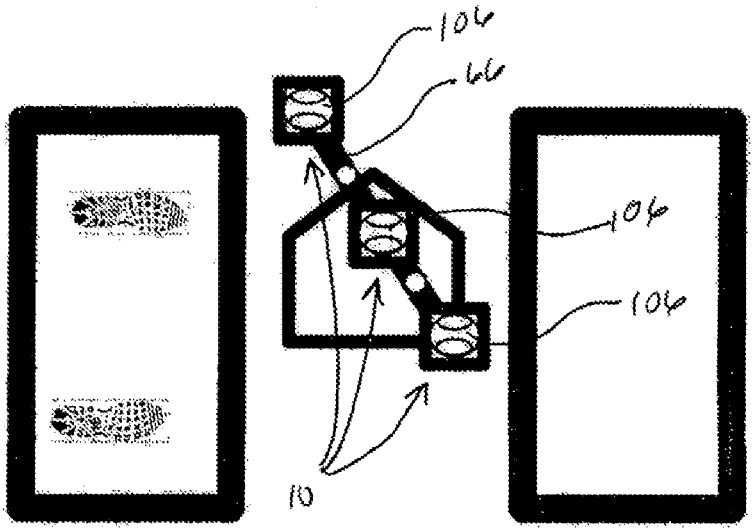

The basic components of the batting tee shown in FIGS. 3A through 3C allow the batting tee to be easily customized to different user as well as allowing different training drills to be performed. The batting tee may be easily set up with the single mounting head 58 and a single tee 10 at different heights for different users. As such, the system easily allows for different heights of users, such as adults or children, and allows a user to adjust to high or low pitches. The T-bar mounting head 66 may be used with multiple tees 10 to teach specific batting skills As shown in FIGS. 10 and 11, a tee 10 which is empty may be used in front of a tee 10 which has a ball placed thereon in order to keep a batter swinging on a level plane or to keep a batter from swinging low and scooping up towards the ball. The T-bar mounting head 66 may be placed at an angle to the user as shown in FIG. 13, allowing a tee 10 to be placed outside of the tee 10 which carries a ball, teaching the user to hit the ball using proper technique.

Figure 4:
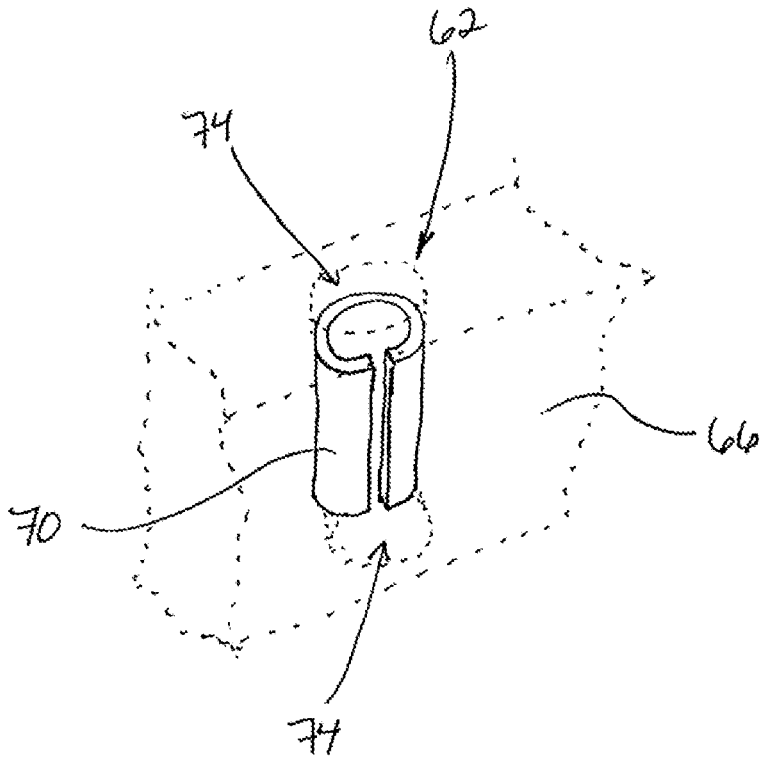
FIGS. 4 and 5 show a batting tee clamp of the present system.

FIG. 4 shows a partial perspective view of a tee clamp 62. The rod 18 of a tee 10 passes through one of the clamps 62 formed in the single mounting head 58 or the T-bar mounting head 66. Each clamp uses a split nylon tube 70 which is held captive inside of the mounting head body. The split nylon tube 70 is loose within the mounting head body, but is constrained therein and can not come out of the body. Thus, the clamp 62 essentially comprises a hole 74 extending through the mounting head body and the split nylon tube 70 held captive around the bore of the hole. Typically, the support rod 18 is one half inch polyacetal, and the split nylon tube is a one half inch inside diameter tube.

The inventor has found that the nylon tube 70 collapses to a smaller diameter when cut, and maintains a slight bias towards this smaller diameter. Thus, when the support rod 18 is placed through the split nylon tube 70, the tube 70 grips the support rod 18 and holds it in place. The inventor has found that the nylon is advantageous as it will maintain itself in this collapsed state without experiencing fatigue and a loss of grip on a support rod 18. Additionally, the nylon has a desirable amount of friction which holds the support rod 18 securely while still being easy to adjust, insert or remove a support rod therefrom. The split nylon bushing 70 is preferably made from nylon having about a one inch length, a one half inch inside diameter, a three fourths inch outside diameter, and about a one sixteenth inch cut made along one side as shown.

Figure 5:
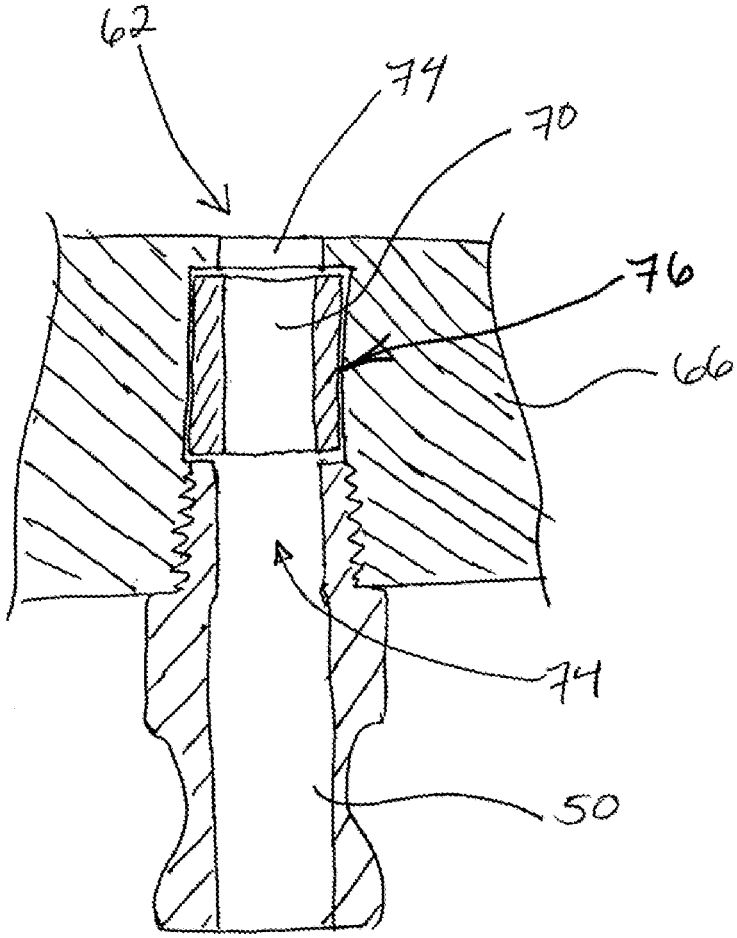

FIG. 5 shows a cross-sectional view of a clamp 62. The middle clamp 62 of the T-bar mounting head 66 is shown. It can bee seen how the split nylon tube 70 is held adjacent the hole 74 in side of a cavity 76 in the mounting head 66. The quick release coupler portion 50 threads into the mounting head 66, and holds the nylon tube 70 inside of the mounting head 66. Where a coupler 50 is not used, a cylindrical plug with a hole 74 therethrough may be inserted in the place thereof to hold the split nylon tube 70 in the cavity 76. The plug is typically threaded, pressed or glued into the mounting head 66. The various clamps 62 of the T-bar adapter head 66 and single adapter head 58 are similarly constructed.

Figure 6:
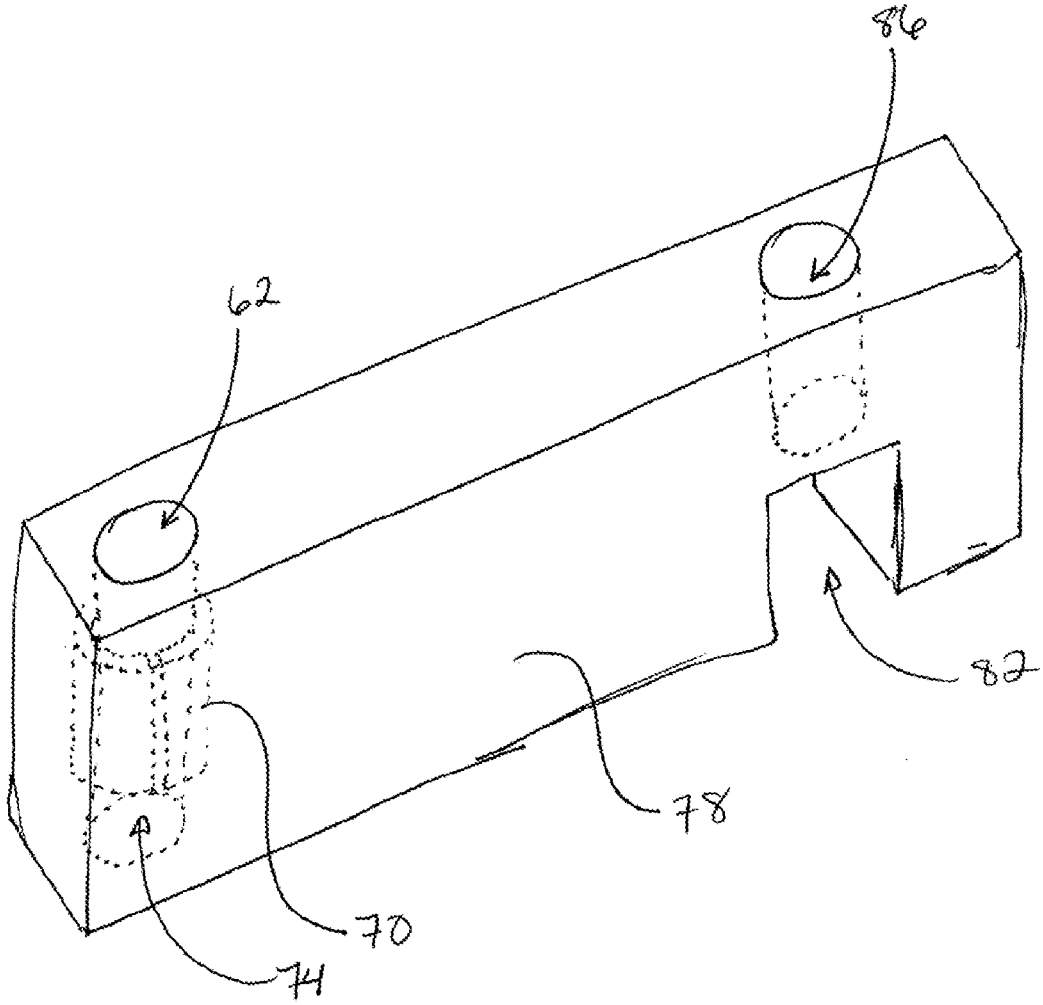
FIGS. 6 and 7 show a Nocast training adapter of the present system.

Turning now to FIG. 6, a Nocast adapter bar 78 is shown. The adapter bar 78 has a clamp 62 as previously discussed formed at one end and a notch 82 and hole 86 formed at the opposite end. The Nocast adapter bar 78 is preferably about eight inches long, two inches high and one inch thick, with a six inch distance between the clamp 62 and hole 86. The notch 82 is about one inch wide and one inch tall, and fits over the T-bar mounting head 66.

Figure 7:
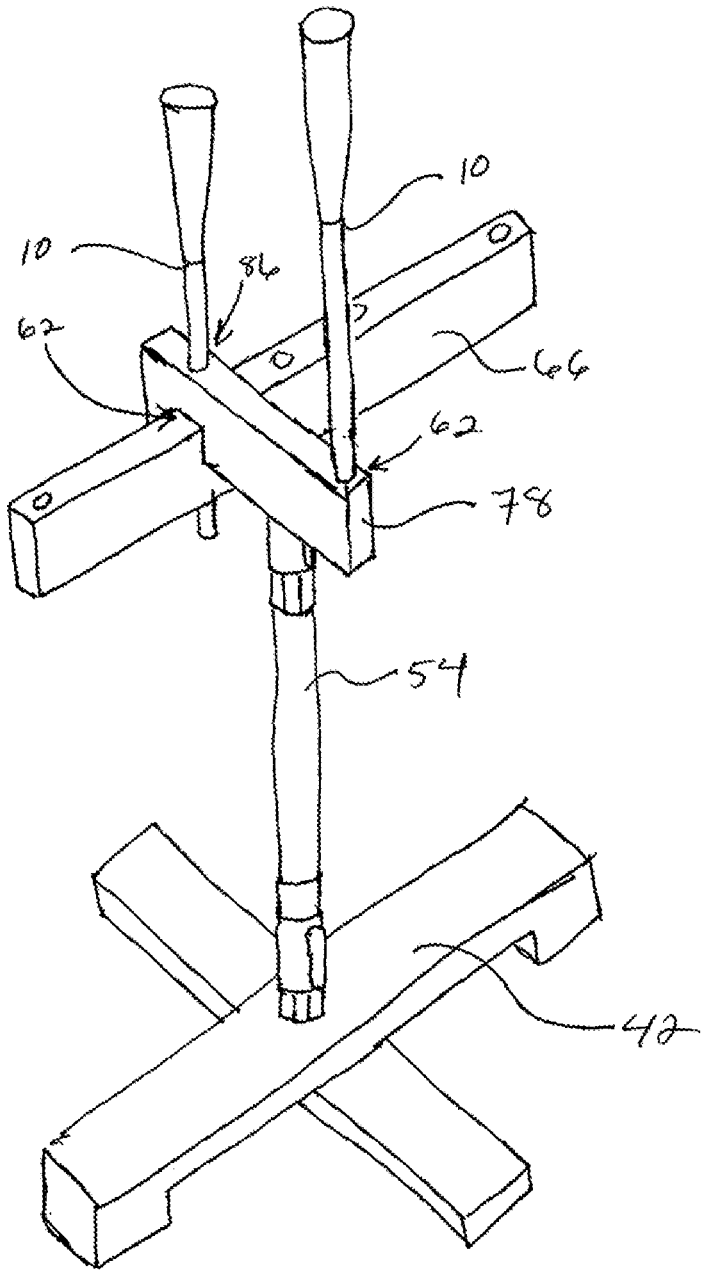

FIG. 7 shows the Nocast adapter bar 78 mounted to the T-bar mounting head 66. The notch 82 is placed over the mounting head 66 so that the hole 86 is aligned with a clamp 62. A tee 10 is placed through the hole 86 and clamp 62 as shown. Another tee 10 is placed in the adapter bar clamp 62 as shown. The Nocast adapter bar 78 allows various training exercises to be performed as discussed below.

Figure 8:
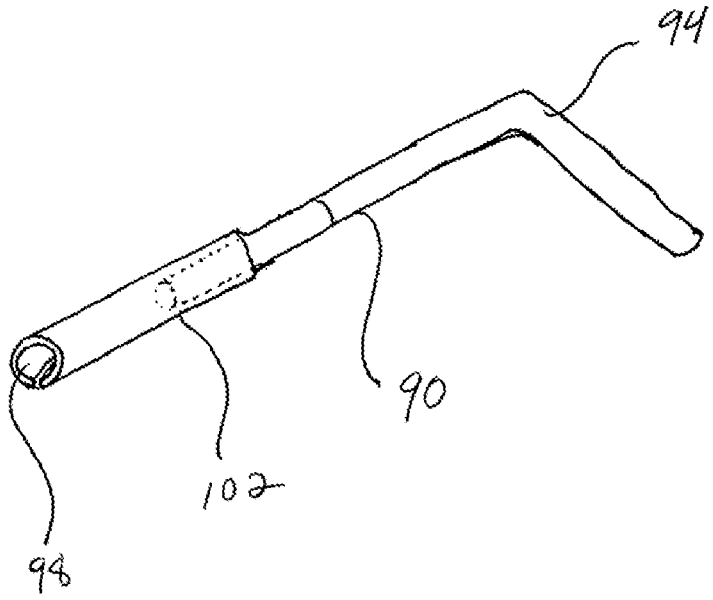
FIGS. 8 and 9 show a Stayback training adapter of the present system.
Figure 9:
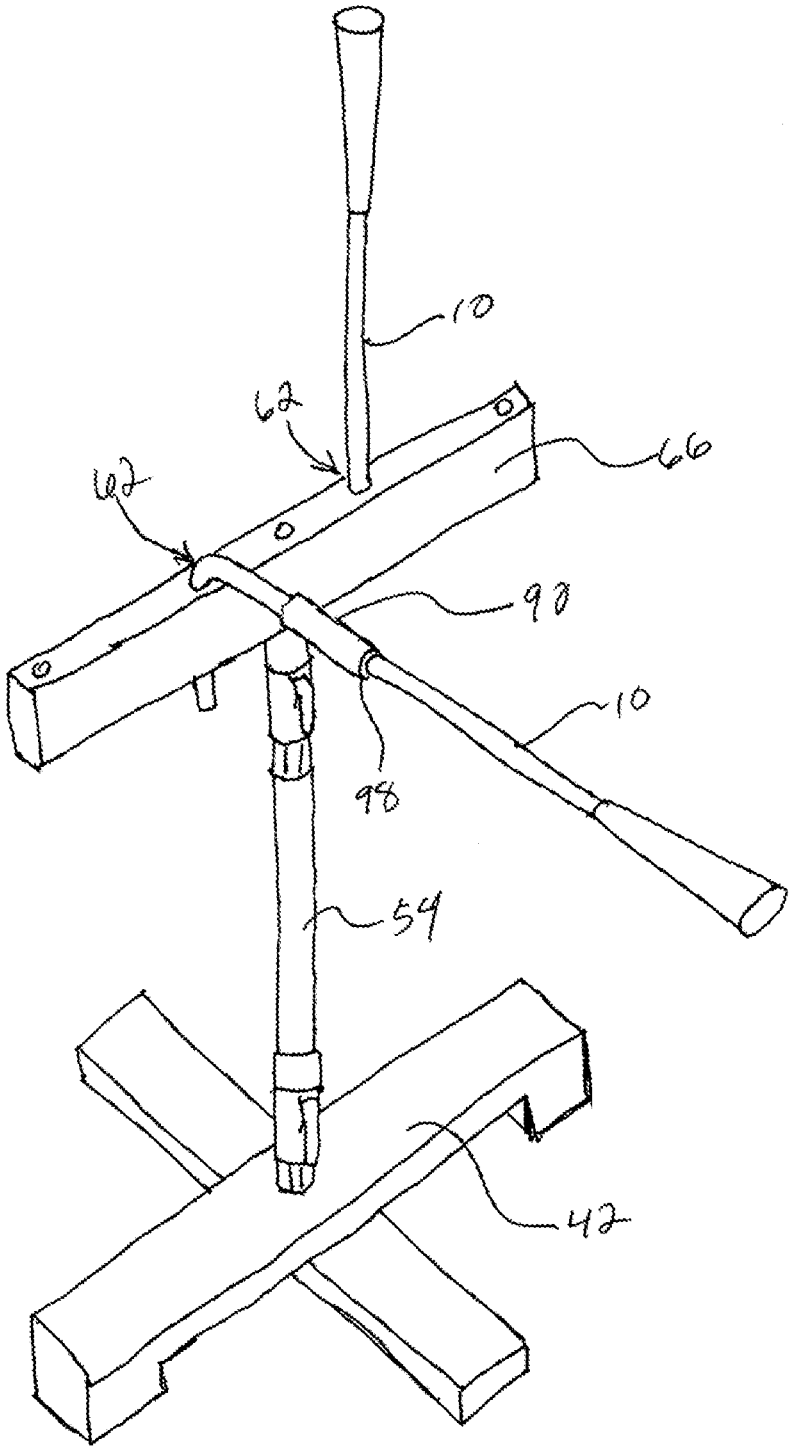

Turning now to FIG. 8, a Stayback adapter 90 is shown. The Stayback adapter includes a one half inch rod 94 which is bent at about a 70 degree angle as shown. The rod 94 is preferably made of nylon. A split nylon tube 98 is placed over the end of the nylon rod 94 and secured with an adhesive or jacket 102, such as a heat shrink tube. As shown in FIG. 9, the Stayback adapter 90 is placed into one of the clamps 62 in the T-bar mounting head 66. A tee 10 (or a piece of one half inch rod) is placed into the split tube 98 to extend the Stayback adapter 90. Another tee 10 is placed into another clamp 62 in the mounting head 66. The Stayback adapter 90 trains a batter to not shift their weight too far forwards while swinging, as discussed below.

FIGS. 10 through 17 shows different ways that the batting tee system can be set up to perform various training drills to teach specific batting skills In FIGS. 10 through 17, parts of the batting tee such as the base or extension post sections are not shown for clarity, but are understood to be used therewith. FIGS. 11, 13, 16 and 17 show top views of how the batting tee system would be placed in a batting box to perform the desired training exercise.

Turning now to FIGS. 10 and 11, the T-bar mounting head 66 is shown with two tees 10. The tees 10 are placed at the ends of the mounting head 66, and are used to teach a batter the proper bat path. A ball 106 is placed on the front support 10, and the rear support 10 is placed at any desired height to control the desired swing path through the hitting contact zone. For example, the rear support 10 may be placed slightly higher than the front support 10 so as to block a level path 110 to the ball 106, forcing the batter to use a declining path 114 to hit the ball.

The training drill teaches the batter to take the barrel of the bat through a proper direct bat path to the ball and keeps the bat barrel on the same parallel plane as the ball for as long as possible as the ball travels through the hitting zone (it is appreciated that the ball is sinking as it travels through the hitting zone). The batter will also strike the center of the ball at a slight 3-5 degree down angle which will cause the ball to spin backwards, increasing the carrying distance of the ball. The batting tee system can train a hitter to perform all these elements of a complex swing with one tee position set up. The back tee 10 is placed at a height relative to the front tee as a guide so the hitter can receive direct feedback if he/she strikes the back tee top before hitting the ball 106 on the front tee 10. With proper execution, the batter will get a constant reminder when the hitter drops their hands or takes an improper bat path to the ball. The feedback reminder of striking the back tee top will promote a direct path at launch position and an increase in the length the bat barrel stays on plane with the ball. By providing a tool that gives direct feedback each time a hitter swings will increase muscle memory in the tee training phase so the proper reaction and bat path takes place during live pitching and game time.

Figure 12:
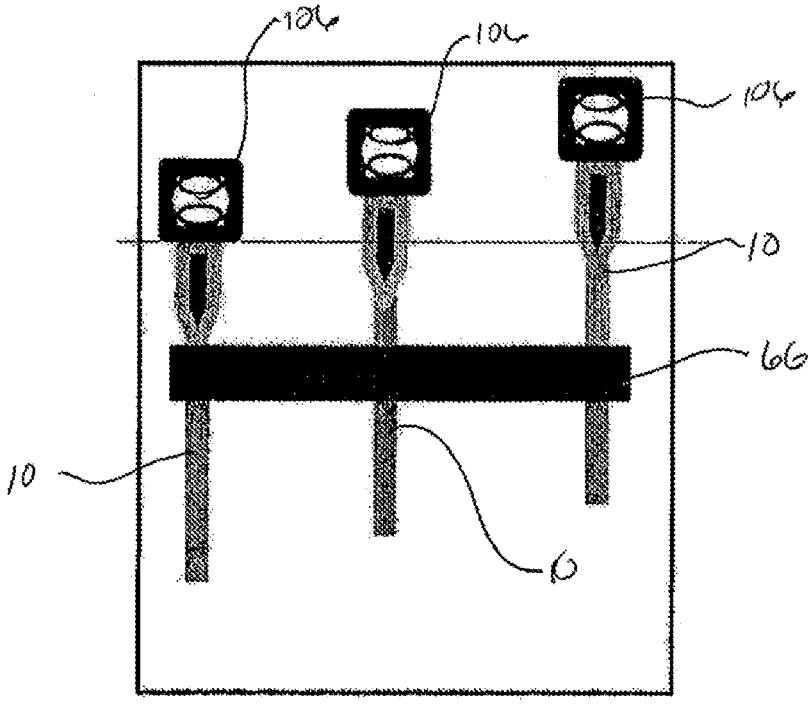

Turning now to FIGS. 12 and 13, the batting tee system is shown using the T-bar mounting head 66 with three tees 10 and three balls 106. The batting tee system is set up to teach a batter to hit balls across the strike zone without moving their feet or shifting their position relative to the batting tee. An effective batter must be able, from the same hitting stance and approach, be able to cover the entire strike zone and hit a ball effectively from anywhere in that strike zone. While using a single post tee, batters tend to move feet and body position to account for balls held in different locations. This action is detrimental to training because the batter is training movements that will not increase success of hitting the ball squarely. The present batting tee system can place a single ball or multiple balls in any part of the strike zone and at virtually any height from approximately 10 inches from the ground for small hitters and low pitches to almost any reasonable height by adjusting the sliding tee top 10 and adding post extensions 54. Using multiple balls as shown, the hitter must use the same stance and approach for all 3 balls which increases the chance of success during a game significantly.

Effective hitting techniques also stress that hitters hit a ball pitched on the inside portion of the plate before it reaches them or out in front of them relative to the hitter and, for a right handed hitter, to hit the ball to the left side of the field to maximize power and increase the odds of reaching first base safely. The hitter should also try to hit the outside ball by letting it travel deeper into the strike zone and using specific techniques to hit the ball to right field, for a right handed batter. By placing the T-bar mounting head 66 on approximately a 45 degree angle as shown in FIG. 13, the hitter can train to have an effective swing covering the entire strike zone. The hitter is trained to hit all three balls from the same stance while simultaneously learning to hit the inside ball at a more forward location and the outside ball in a more rearward location.

Figure 14:
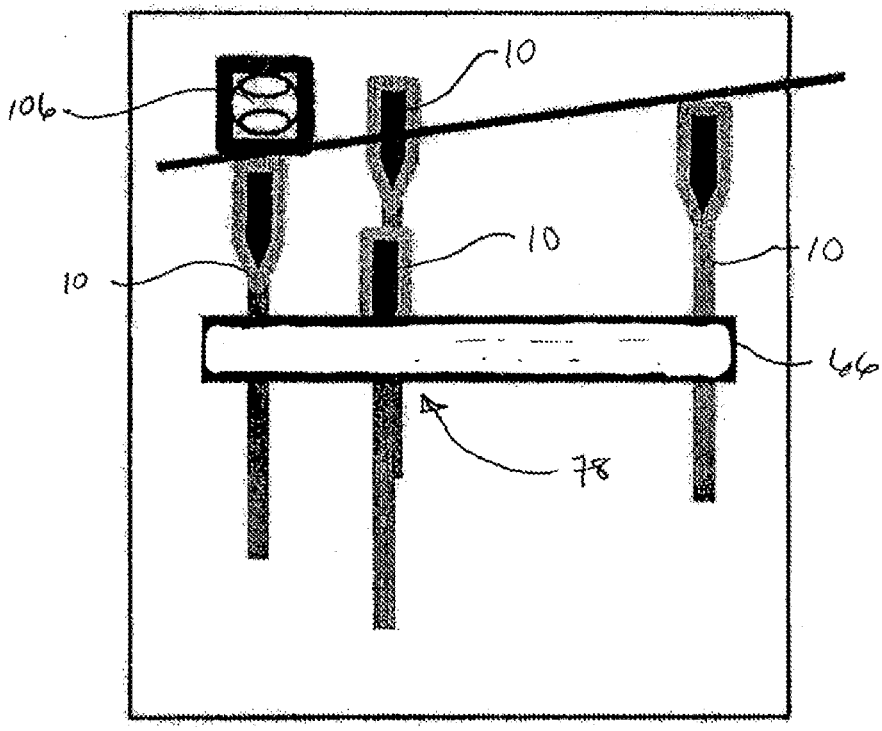
Figure 15:
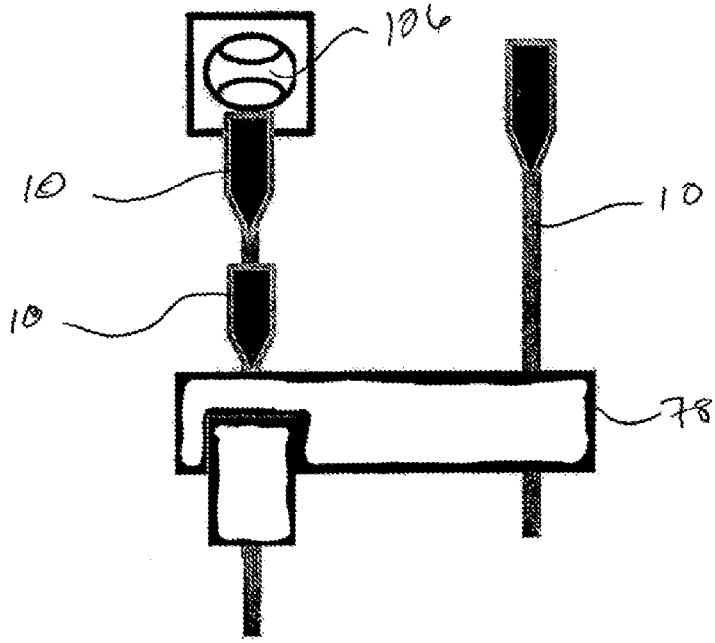
Figure 16:
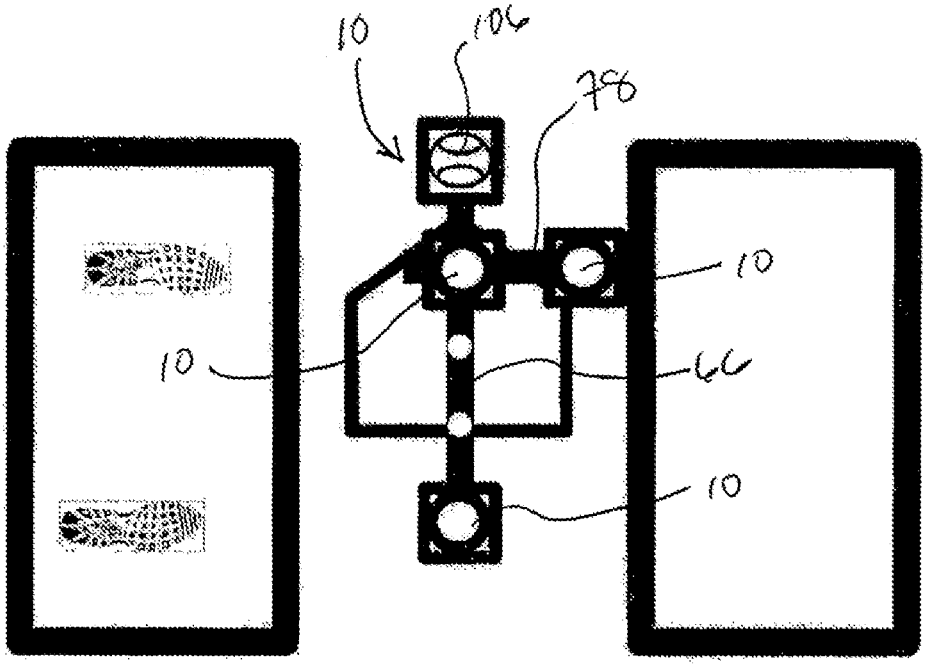

Turning now to FIGS. 14 through 16, the use of the Nocast adapter 78 is shown. The Nocast adapter 78 is used to teach proper bat movement while batting. The adapter 78 is connected to the T-bar mounting head 66 with a tee 10, and holds another tee 10 farther away from a batter than the ball 106 and up as high as the ball. The Nocast adapter 78 is set up in a similar manner as is shown in FIG. 7.

To illustrate why the adapter 78 aids in training a hitters swing mechanics it is useful to understand the technical elements common among hitters at the highest level of competition. Common terms in swing mechanics training in both baseball and softball are the terms of "Keeping your hands inside the ball" and "bat lag". This means that when hands leave the launch position to start a swing, they should take as direct as possible path to the ball with the barrel of the bat "lagging" behind so that when the hands and arms reach full extension the batter uses their wrists to pivot the barrel of the bat through the hitting area at a significantly increased rate of speed. When the bat makes contact with the ball the hands should be in line with or slightly ahead of the ball. If the hands are parallel or slightly ahead of the bat barrel at contact with the ball then the ball when hit is more apt to stay or be hit through the middle of the field and in fair play territory. This position also maximizes the transfer of energy generated from the body, through the hands and then to the bat in a balanced and controlled fashion.

The Nocast adapter 78 can be placed onto the T-bar mounting head 66 at any of the clamps 62 and, by positioning a tee top 10 slightly higher than the tee top 10 with the ball 106, teach the hitter to properly move the bat through the hitting zone without hitting the tee 10 in the adapter 78. If the hitter swings and makes proper contact with the ball without hitting the tee 10 in the adapter 78, he/she has executed the training correctly. If contact is made with the tee 10 in the adapter 78 while attempting to hit the ball the hitter receives instant sensory feedback of improper execution of the training drill. The adapter 78 thus promotes a more direct hand path to the ball and encourages the proper "bat lag" on approach to the ball.

Figure 17:
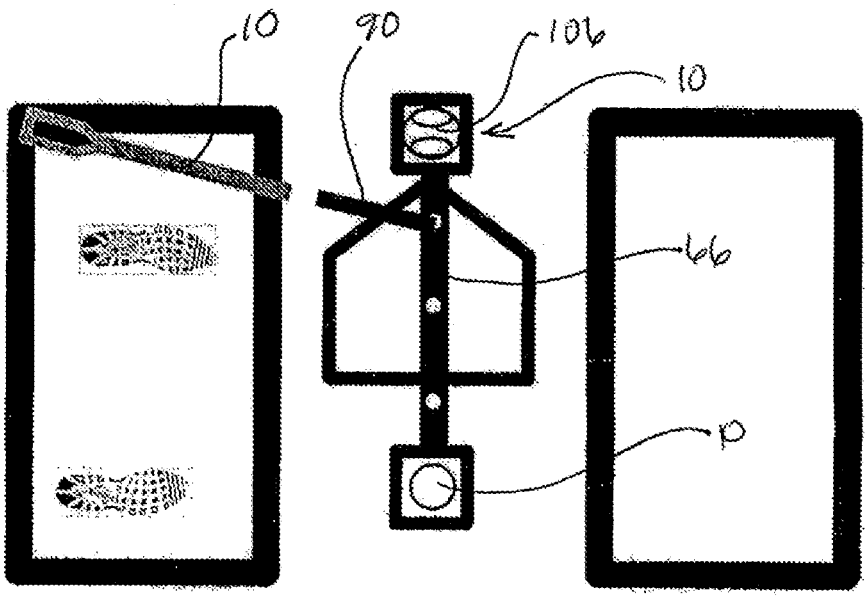

Turning now to FIG. 17, a training drill using the Stayback adapter 90 is shown. FIG. 17 shows a use of the adapter 90 in a position similar to that shown in FIG. 9. The Stayback adapter 90 helps batters determine proper body positioning and stride length while batting. Balance is critical because a batter must prepare for a change of pitch speed or a pitch that changes direction (curveball, slider, changeup) or both a change in direction and speed. It is common when teaching proper batting mechanics to teach stride length, or how far a batter moves his/her front foot from the starting position.

The Stayback adapter 90 inserts into any clamp 62 in the T-bar mounting head 66 and receives a tee 10 or another rod that extends the adapters overall length and places the tee 10 across the front leg of the hitter. The adapter 90 can pivot freely with some friction so the batter can adjust the Stayback adapter 90 to the desired stride length position. Once the desired stride length is determined and the Stayback adapter 90 is placed in that desired position the batter can practice hitting off the tee and feel the tee top or extension in the Stayback adapter make contact against his/her leg if he/she "overstrides" or steps too for forwards with their front foot while swinging. This process improves muscle memory and conditioning to achieve and execute a proper stride length during competitive play. The Stayback adapter 90 is used in combination with the other parts of the system, and may be used in the batting setups shown in the previous figures.

There is thus disclosed an improved batting tee system. It will be appreciated that numerous changes may be made to the present invention without departing from the scope of the claims.

What is claimed is:

1. A batter training system comprising:

a base;

a mounting head attached to the top of the base;

wherein the mounting head has a clamp for receiving a batting tee, the clamp comprising:

a hole through the mounting head;

a cavity formed in the mounting head coaxial with the hole;

a plastic tube which is cut lengthwise on a side thereof, wherein the plastic tube is disposed loosely in the cavity and uncompressed when assembled, and wherein the plastic tube is sized to create an interference fit with a batting tee which is inserted therethrough; and a batting tee attached to the mounting head, wherein the batting tee receives a baseball or softball thereon.

2. The system of claim 1, wherein the batting tee comprises:

an elongate rod;

a cone attached to the end of the rod and having an open end to receive a baseball, the cone comprising alternating layers of rubber and cloth rolled into a cone.

3. The system of claim 2, wherein the layers of rubber and cloth are not attached to each other above the elongate rod.

4. The system of claim 1, wherein the plastic tube is held captive in the cavity.

5. The system of claim 1, wherein the mounting head is disposed a distance above the base, and wherein the mounting head comprises a horizontally elongate head having a plurality of mounting locations where a batting tee may be placed.

6. The system of claim 1, wherein the plastic tube is a nylon tube.

7. A batter training system comprising:

a batting tee, the batting tee comprising:

an elongate rod;

alternating layers of rubber and a cloth material rolled to form a cone, the cone being placed on a first end of the rod, the cone receiving a baseball or softball on the top thereof to allow a batter to hit the ball;

wherein the cloth material is a synthetic material; and wherein the cloth material covers the exterior face of the rubber and inhibits contact between a bat and the rubber.

8. The system of claim 7, further comprising:

a base; and a mounting head attachable to the base at a distance above the base, the mounting head having a mounting location for receiving the elongate rod of the tee.

9. The system of claim 8, wherein the mounting head comprises a horizontally elongate bar having multiple mounting locations disposed along a length of the bar, and wherein each of the mounting locations may receive an elongate rod of a batting tee vertically through the elongate bar such that the rod extends below the bottom of the mounting head and such that the height of the batting tee may be adjusted independently of a batting tee disposed in another mounting location.

10. The system of claim 8, wherein the clamp comprises:

a hole in the mounting head;

a cavity in the mounting head coincident with the hole; and a plastic tube disposed in the cavity, the plastic tube being split along a single side thereof and having an inner diameter which is smaller than the batting tee elongate rod, the elongate rod being received through the hole and in the plastic tube.

11. The system of claim 10, wherein the plastic tube is formed from nylon.

12. The system of claim 7, wherein the cloth material is a woven cloth.

13. The system of claim 7, wherein the rubber and cloth material are not attached together above the elongate rod.

14. The system of claim 7, wherein the rod is made of polyacetal.

15. A batter training system comprising:

a base;

a mounting head attached to the top of the base a distance above the base, wherein the mounting head comprises a horizontally elongate head having multiple mounting locations where a batting tee may be placed disposed along a length of the mounting head; and a batting tee attached to the mounting head, wherein the batting tee top receives a baseball or softball thereon, the batting tee having an elongate portion which passes through the mounting head;

a Stayback adapter which comprises:

a first elongate section of rod disposed vertically through one of the mounting locations in the mounting head, a second elongate section attached to an end of the first elongate section, the second elongate section being disposed at an angle to the first section of elongate rod, and wherein the second section extends horizontally away from the mounting head generally perpendicular to the mounting head; and the batting tee is disposed vertically in one of the mounting locations in the mounting head.

16. The system of claim 15, further comprising a Nocast adapter which comprises:

a horizontally elongate bar having a first end and a second end;

wherein the first end is attached to the mounting head such that the first end of the elongate bar is disposed on the mounting head over one of the mounting locations and an elongate rod is placed through said mounting location such that the horizontally elongate bar extends laterally from the mounting head;

a Nocast mounting location on the second end of the horizontally elongate bar;

an elongate rod disposed vertically in the Nocast mounting location so as to extend vertically above the horizontally elongate bar.

17. The system of claim 15, wherein the Stayback adapter further comprises a mount disposed on a distal end of the second elongate section and an elongate rod disposed in the mount and extending laterally from the mounting head in the direction of the second elongate section.

18. The system of claim 15, wherein the angle is approximately a 70 degree angle.

19. The system of claim 15, wherein the mounting head is disposed in front of a batter and generally parallel to the body of a batter, wherein the first elongate section of rod is disposed in a mounting location in the mounting head such that the second elongate section extends across the side of the batter, and wherein a batting tee is disposed in a second mounting hole in the mounting head.

20. The system of claim 15, wherein the mounting locations in the mounting head each may receive an elongate rod vertically such that the rod extends through the mounting head and such that the rod is movable vertically to extend above the mounting head a variable height.

21. A batter training system comprising:

a base;

a mounting head attached to the top of the base a distance above the base, wherein the mounting head comprises a horizontally elongate head having multiple mounting locations where a batting tee may be placed disposed along a length of the mounting head; and a batting tee attached to the mounting head, wherein the batting tee top receives a baseball or softball thereon, the batting tee having an elongate portion which passes through the mounting head;

a Nocast adapter which comprises:

a horizontally elongate bar having a first end and a second end;

wherein the first end is attached to the mounting head such that the first end of the elongate bar is disposed on the mounting head over one of the mounting locations and an elongate rod is placed through said mounting location such that the horizontally elongate bar extends laterally from the mounting head;

a Nocast mounting location on the second end of the horizontally elongate bar;

an elongate rod disposed vertically in the Nocast mounting location so as to extend vertically above the horizontally elongate bar; and the batting tee is disposed in one of the mounting locations in the mounting head.

22. The system of claim 21, wherein the first end of the horizontally elongate bar comprises a notch and wherein the notch is placed over said one of the mounting locations.

* * * * *